US009156187B2

(12) United States Patent
Bhagavat et al.

(10) Patent No.: US 9,156,187 B2
(45) Date of Patent: Oct. 13, 2015

(54) METHODS FOR MOUNTING AN INGOT ON A WIRE SAW

(71) Applicant: MEMC Electronic Materials, Inc., St. Peters, MO (US)

(72) Inventors: Sumeet S. Bhagavat, St. Charles, MO (US); Carlo Zavattari, Varallo Pombia (IT); Yunbiao Xin, Palo Alto, CA (US); Roland R. Vandamme, Wentzville, MO (US)

(73) Assignee: SunEdison Semiconductor Ltd., Singapore (SG)

( * ) Notice: Subject to any disclaimer, the term of this patent is extended or adjusted under 35 U.S.C. 154(b) by 305 days.

(21) Appl. No.: 13/724,050

(22) Filed: Dec. 21, 2012

(65) Prior Publication Data

US 2013/0174829 A1 Jul. 11, 2013

Related U.S. Application Data

(60) Provisional application No. 61/581,281, filed on Dec. 29, 2011.

(51) Int. Cl.

| | |
|---|---|
| ***B28D 1/10*** | (2006.01) |
| ***B28D 5/04*** | (2006.01) |
| *B28D 5/00* | (2006.01) |

(52) U.S. Cl.

CPC *B28D 1/10* (2013.01); *B28D 5/045* (2013.01); *B28D 5/0082* (2013.01)

(58) Field of Classification Search

CPC ..... B23D 61/185; B24B 49/05; B28D 1/10; B28D 1/08; B28D 5/045; B28D 5/0082; B28D 5/0094

USPC ..... 125/1, 16.02, 21, 35; 451/9, 41

See application file for complete search history.

(56) References Cited

U.S. PATENT DOCUMENTS

| | | | | |
|---|---|---|---|---|
| 5,439,723 | A * | 8/1995 | Miyashita et al. | 428/66.7 |
| 5,529,051 | A * | 6/1996 | Miller | 125/12 |
| 5,839,425 | A * | 11/1998 | Toyama et al. | 125/16.02 |
| 6,112,738 | A * | 9/2000 | Witte et al. | 125/16.02 |
| 6,122,562 | A * | 9/2000 | Kinney et al. | 700/121 |
| 6,559,457 | B1 * | 5/2003 | Phan et al. | 250/491.1 |
| 6,886,550 | B2 * | 5/2005 | Hauser | 125/21 |

(Continued)

FOREIGN PATENT DOCUMENTS

| | | | |
|---|---|---|---|
| CH | 696757 | A5 | 11/2007 |
| DE | 102011008397 | A1 | 7/2011 |
| WO | 8901395 | A1 | 2/1989 |

OTHER PUBLICATIONS

International Search Report and Written Opinion from the International Searching Authority regarding PCT/US2012/071715 filed on Dec. 27, 2012 issued on Apr. 25, 2013; 9 pgs.

*Primary Examiner* — Timothy V Eley
(74) *Attorney, Agent, or Firm* — Armstrong Teasdale LLP

(57) ABSTRACT

Methods are disclosed for determining mounting locations of ingots on a wire saw machine. The methods include measuring a test surface of a test wafer previously sliced by the wire saw machine from a test ingot to calibrate the system. A magnitude and a direction of an irregularity of the measured test surface of the test wafer is then determined. The mounting location is then determined for another ingot to be mounted on the ingot holder based on at least one of the magnitude and direction of the irregularity of the measured test surface of the test wafer.

18 Claims, 4 Drawing Sheets

(56) References Cited

U.S. PATENT DOCUMENTS

| | | | | |
|---|---|---|---|---|
| 7,311,101 | B2 | 12/2007 | Nakashima | |
| 2006/0060180 | A1 | 3/2006 | Nakashima | |
| 2006/0108325 | A1* | 5/2006 | Everson et al. | 216/88 |
| 2010/0180880 | A1 | 7/2010 | Oishi et al. | |
| 2010/0258103 | A1 | 10/2010 | Kitagawa | |
| 2013/0144421 | A1* | 6/2013 | Zavattari et al. | 700/108 |
| 2013/0174828 | A1* | 7/2013 | Zavattari et al. | 125/21 |

* cited by examiner

METHODS FOR MOUNTING AN INGOT ON A WIRE SAW

CROSS-REFERENCE TO RELATED APPLICATION

This application claims priority to U.S. Provisional Patent Application No. 61/581,281 filed on Dec. 29, 2011, the entire disclosure of which is hereby incorporated by reference in its entirety.

FIELD

This disclosure relates generally to wire saw machines used to slice ingots into wafers and, more specifically, to methods for determining mounting locations of the ingots on the wire saws.

BACKGROUND

Semiconductor wafers are typically formed by cutting an ingot with a wire saw machine. These ingots are typically made of silicon or other semiconductor or solar grade material. The ingot is connected to the structure of the wire saw by a bond beam and an ingot holder. The ingot is bonded with adhesive to the bond beam, and the bond beam is in turn bonded with adhesive to the ingot holder. The ingot holder is connected by any suitable fastening system to the wire saw structure.

In operation, the ingot is contacted by a web of moving wires in the wire saw that slice the ingot into a plurality of wafers. The bond beam is then connected to a hoist and the wafers are lowered onto a cart.

Wafers cut by known saws may have surface defects that cause the wafers to have nanotopology that deviates from set standards. In order to ameliorate the deviating nanotopology, such wafers may be subject to additional processing steps. These steps are time-consuming and costly. Thus, there exists a need for a more efficient and effective system to control nanotopology of wafers cut in a wire saw machine.

This section is intended to introduce the reader to various aspects of art that may be related to various aspects of the disclosure, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

SUMMARY

A first aspect is a method of determining a mounting location of an ingot on an ingot holder. The ingot holder is used to attach the ingot to a wire saw machine. The wire saw machine is used for slicing the ingot into wafers. The ingot has a length. The method includes measuring a test surface of a test wafer sliced by the wire saw machine from a test ingot, which has a length, determining a magnitude and a direction of an entry mark of the measured test surface, determining a length ratio of the length of the test ingot to the length of the ingot, and determining a mounting location of the ingot on the ingot holder based on the length ratio and the magnitude and direction of the entry mark of the measured test surface of the test wafer sliced from the test ingot.

Another aspect is a method of determining a mounting location of an ingot on an ingot holder. The ingot holder is used to attach the ingot to a wire saw machine. The wire saw machine is used for slicing the ingot into wafers. The method includes measuring a test surface of a test wafer previously sliced by the wire saw machine from a test ingot, determining at least one of a magnitude and a direction of an irregularity of the measured test surface, and determining a mounting location of the ingot on the ingot holder based on at least one of the magnitude and direction of the irregularity of the measured test surface of the test wafer sliced from the test ingot.

Still another aspect is a population of semiconductor or solar wafers sliced from an ingot by a wire saw. The ingot is mounted to an ingot holder used to attach the ingot to the wire saw. The ingot is offset from a center of the ingot holder. The wafers have surfaces substantially free from entry marks prior to being subjected to downstream processing operations.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION

Figure 1:
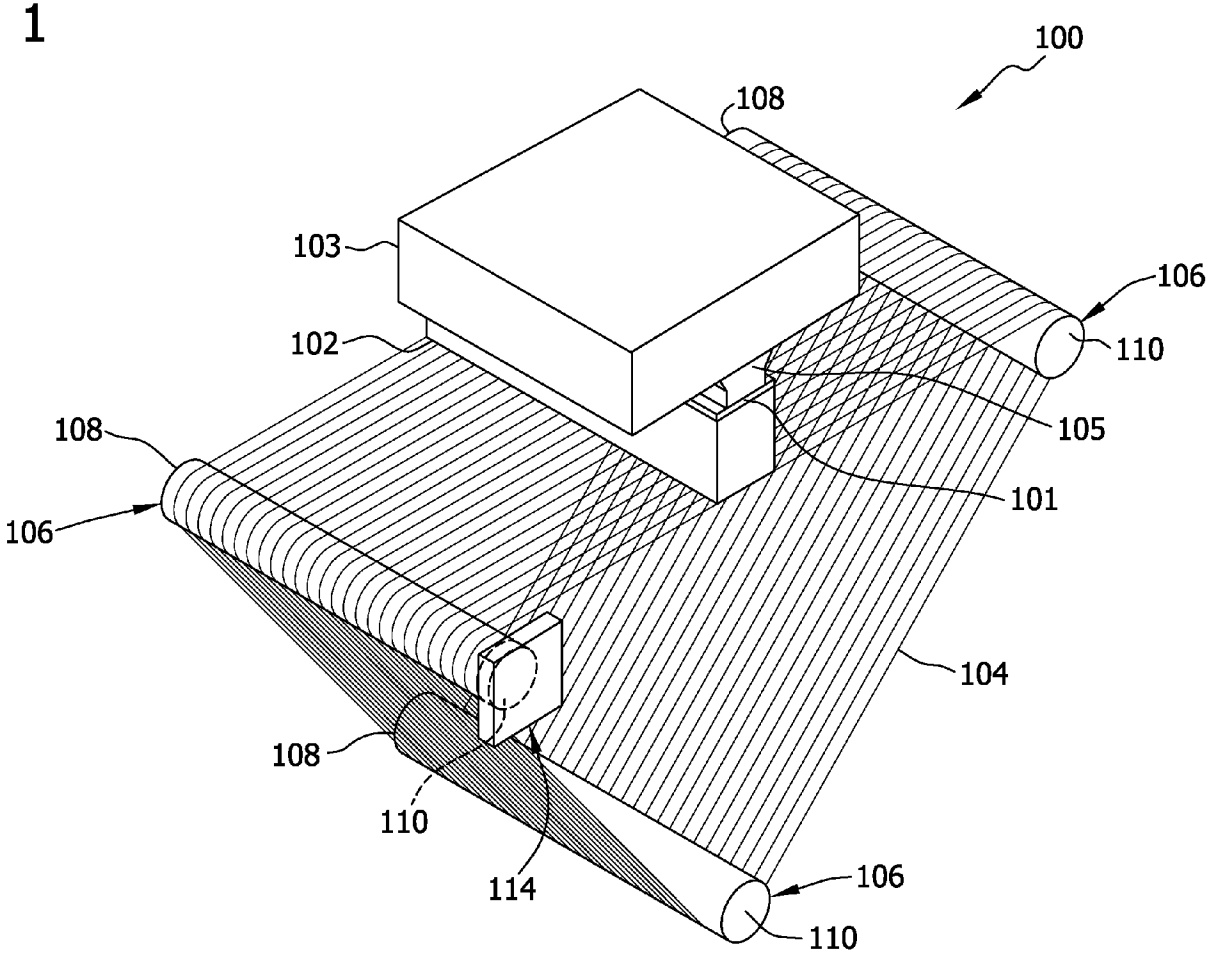
FIG. 1 is a perspective view of a system including an ingot and a wire saw machine.
Figure 2:
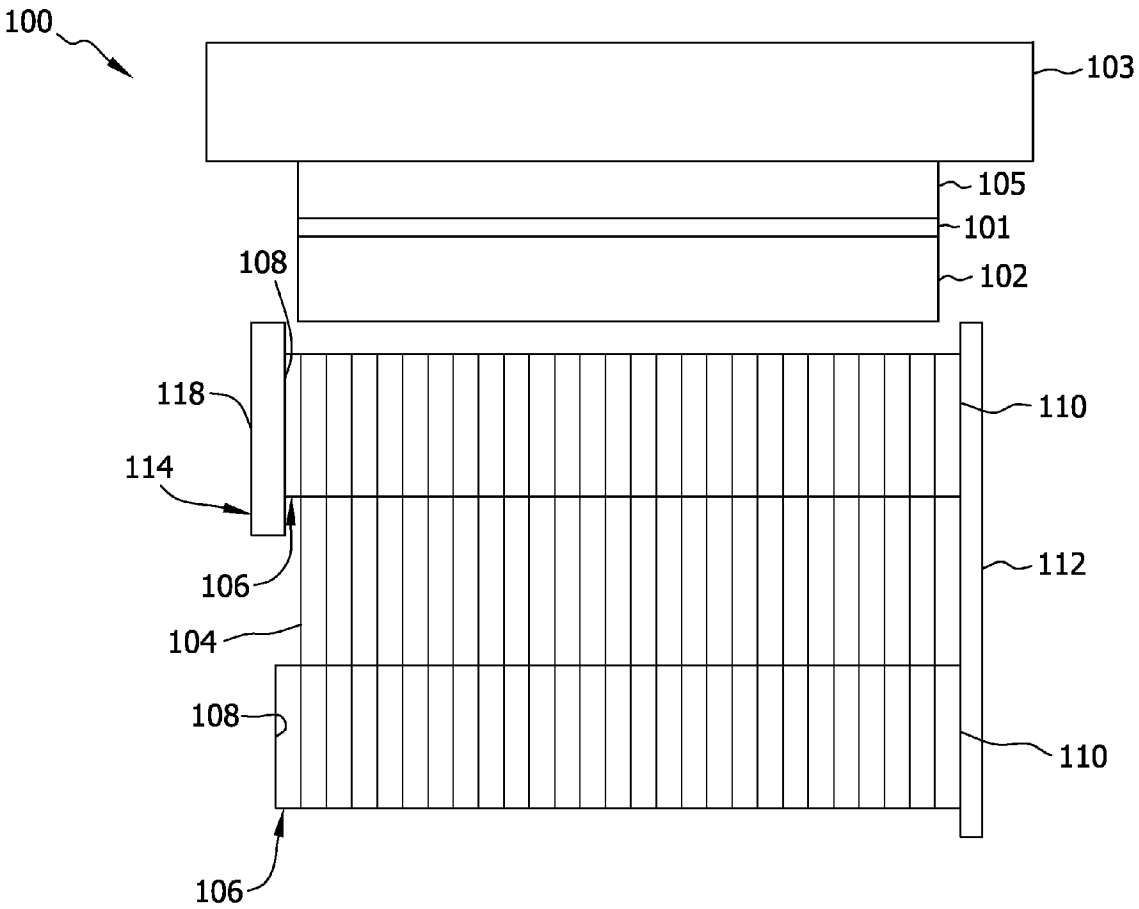
FIG. 2 is a front view of an ingot attached to the wire saw machine in a centered position.
Figure 3:
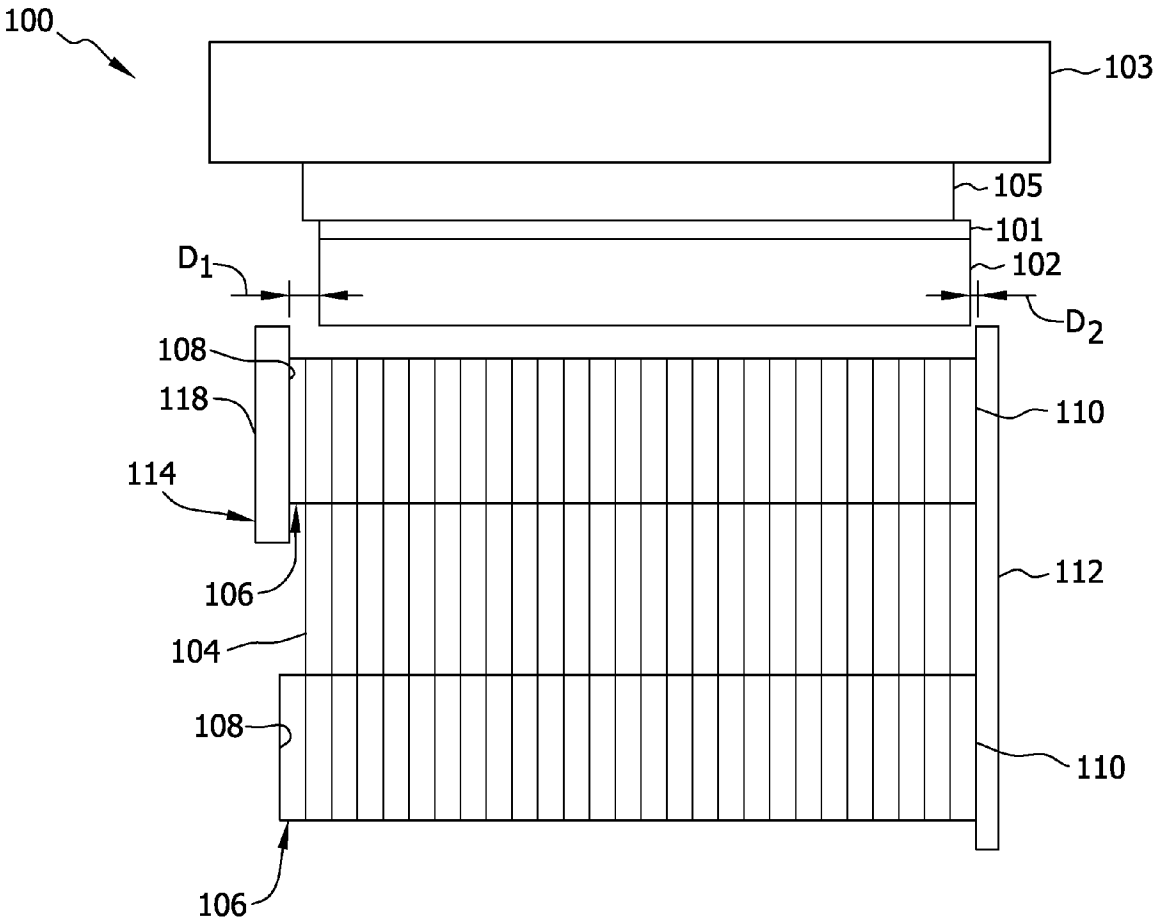
FIG. 3 is a front view of an ingot attached to the wire saw machine in an offset position.

Referring to FIGS. 1-3, a system for slicing an ingot 102 into wafers by a wire saw machine 103 is shown and indicated generally at 100. The ingot is formed of silicon, but may also be formed of other suitable materials. The system 100 is generally operable to determine a mounting location of the ingot 102 on a clamping rail 105 to reduce or limit irregularities in a surface of the wafers sliced from the ingot 102. Embodiments of the systems and methods described herein are operable to reduce or limit the entry and/or exit marks formed in the surfaces of wafers cut by wire saw machines, resulting in improve nanotopology of the surfaces of the wafers.

Nanotopology has been defined as the deviation of a wafer surface within a spatial wavelength of about 0.2 mm to about 20 mm. This spatial wavelength corresponds very closely to surface features on the nanometer scale for processed semiconductor wafers. The foregoing definition has been proposed by Semiconductor Equipment and Materials International (SEMI), a global trade association for the semiconductor industry (SEMI document 3089). Nanotopology measures the elevational deviations of one surface of the wafer and does not consider thickness variations of the wafer, as with traditional flatness measurements. Several metrology methods have been developed to detect and record these kinds of surface variations. For instance, the measurement deviation of reflected light from incident light allows detection of very small surface variations. These methods are used to measure peak to valley (PV) variations within the wavelength. Nanotopology of a finished surface of the wafer can be predicted or estimated based on measurements taken of the surface after it has been sliced, but before it is subject to polishing.

The wire saw 103 (i.e., a wire saw machine) is used to slice ingots 102 made of a semiconductor material (e.g., silicon) or a photovoltaic material. The wire saw 103 may also be used to slice ingots of other materials into wafers.

The wire saw 103 is of the type used to slice (i.e., cut or saw) the ingot 102 into wafers with a web of wires 104. The ingot 102 is connected to a bond beam 101, which is in turn connected to a clamping rail 105. The clamping rail 105 is referred to interchangeably herein as an "ingot holder".

The clamping rail 105 is connected to the wire saw 103. The web of wires 104 travel along a circuitous path around three wire guides 106 when slicing the ingot 102. As shown in FIGS. 1-3, the reduced number of wires 104 and spacing of the wires is greatly exaggerated for clarity. One or more of the wire guides 106 may be connected to a drive source to rotate the guides, and in turn rotate the web of wires 104 about the circuit.

The wire guides 106 have opposing ends 108, 110, that are connected to a frame 112 (only a portion of which is shown) of the wire saw 103 by a bearing 114. The bearings 114 are typical ball bearings, although any suitable type of bearing (e.g., roller bearings) may also be used. A temperature-controlling fluid is in thermal communication with the bearings 114 to regulate the temperature of the bearings. The fluid is in contact with at least a portion of the bearing or a structure that is in turn in contact with the bearing. The fluid is circulated through a temperature control system to regulate the temperature of the fluid and in turn the temperature of the bearings 114.

In operation, a shape of a test surface of a test wafer sliced from a test ingot by the wire saw 103 is measured to calibrate the system 100. Prior to slicing the test ingot, the test ingot is mounted to the ingot holder 105 at a center position, as shown in FIG. 2. In this position, the distance between the ends of the ingot 102 and the ends 108, 110 of the wire guides 106 are equal.

The shape of the surface of the test wafer may be measured by any suitable tool that is operable to measure wafer surfaces. The length of this test ingot may also be measured prior to being sliced by the wire saw 103. The measurements can be stored in the form of a computer readable media, a computer storage device, or other type of computing device.

A determination is then made of a magnitude and a direction of an irregularity (e.g., an entry mark) in the measured test surface of the test wafer. This determination may be made by analyzing the measurements taken of the shape of the test surface of the test wafer. This analysis can be performed by a processor or other computing device.

The magnitude is the physical dimension of the irregularity compared to a specified plane located on or adjacent to the test surface of the wafer. The irregularity's magnitude is the distance that the test surface deviates from the specified plane. The specified plane may define an average surface height of the test wafer or a desired height of the test wafer. The direction of the irregularity indicates on which side of the specified plane the irregularity is disposed. That is, the direction indicates whether the irregularity is disposed beneath the specified plane (i.e., a negative direction) or above the specified plane (i.e., a positive direction).

The irregularity may be an entry mark, which are deformations (e.g., variations) in the surface of the wafer that are positioned relatively near an edge of the wafer. The entry edge is the first part of the ingot 102 contacted by the web of wires 104 during the slicing operation of the ingot into wafers.

Entry marks for ingots having a diameter of about 300 mm are typically referred to as deformations in the surface of the wafer when the location of the deformation is within about 50 mm of the edge of the ingot first contacted by the web of wires 104 during slicing of the ingot. Other irregularities may be referred to as exit marks when the deformation is located near an exit edge of the wafer. The exit edge is the last part of the ingot to be contacted by the web of wires 104 during the slicing operation of the ingot into wafers.

The above described process of slicing a test ingot and measuring the test surface of at least one of the resultant test wafers may be repeated at periodic intervals to calibrate the system 100. Calibration of the system 100 ensures that the measurements of the magnitude and direction of the irregularities on which the mounting location is based are accurate. For example, minor changes during the slicing operation in the components in the wire saw 103 may affect the magnitude and direction of the irregularities. Thus, periodic calibration ensures that the determined mounting location is correct, providing the desired results discussed below.

After calibration, a mounting location of an ingot 102 on the ingot holder 105 is then determined. This mounting location is based on the magnitude and direction of the irregularity in the test surface of the test wafer sliced from the test ingot. The mounting location is also determined based on a length ratio. The length ratio is the length of the test ingot to the length of the ingot 102 being mounted on the ingot holder 105. Use of the length ratio accounts for differences in the irregularities generated in a test ingot having a different length than other ingots that are sliced later by the wire saw machine.

In determining the mounting location of the ingot 102, both an offset distance and an offset direction are determined. The offset distance is the distance that a center of the ingot 102 is offset from the center of the ingot holder 105. The offset direction defines the direction relative to the center of the ingot holder 105 that the center of the ingot 102 is mounted.

The offset distance is equivalent to the magnitude of the entry mark. For example, if the entry mark has a magnitude of 2 units of measurement, the offset distance is also 2 units of measurement. In other embodiments, the offset distance may be equal to a multiple or fraction of the magnitude of the entry mark.

The offset distance may then be adjusted (i.e., reduced or increased) based on the length ratio in some embodiments. Other embodiments, however, may not adjust the offset distance based on the length ratio.

In operation, the offset distance may be increased based on the length ratio when the length of the ingot 102 is greater than that of the test ingot, or the offset distance may be decreased based on the length ratio when the length of the ingot 102 is less than that of the test ingot. The amount by which the offset distance is increased or decreased is determined by multiplying the offset distance by the length ratio.

In other embodiments, the length ratio is calculated using other methods, such as being multiplied by another number, and the product of the two may be multiplied by the previously determined offset distance.

In some embodiments, the offset direction is determined as being in the opposite direction of the direction of the irregularity. That is, if the direction of the irregularity is negative, the offset direction is positive, and vice versa. In operation, if the offset direction is negative the ingot 102 is shifted rightward, as shown in FIG. 3. Likewise, if the offset direction is positive the ingot 102 is shifted leftward. In other embodiments, these directions may each be reversed.

After the offset distance and direction is determined, the ingot 102 is then mounted to the ingot holder 105 with mechanical fasteners attached to the bond beam 101 or by another other suitable fastening system. As shown in FIG. 3, the ingot 102 is mounted to the ingot holder 105 in a position that is shifted right relative to the center because the offset direction was negative. As a result, distance D1, the distance between the ingot 102 and the end 108 of the wire guide 106, is thus greater than distance D2, the distance between the opposite end of the ingot and other end 110 of the wire guide. It should be understood that these distances D1, D2 are greatly exaggerated for clarity.

The mounted ingot 102 is then sliced by the wire saw 103 into wafers. Because of the offset mounting location of the ingot 102, these wafers have surfaces with irregularities of reduced magnitude compared to those of the test wafer. Moreover, the surfaces of the wafers may be substantially free from irregularities in an "as-cut" state, before being subject to downstream processing operations. Additional ingots may then be mounted to the ingot holder using the above-described methods based on the same measurements of the shape of the surface of the test wafer. In addition, the surfaces of a sliced wafer may be measured to calibrate the system and adjust the mounting location of subsequently mounted ingots.

Figure 4:
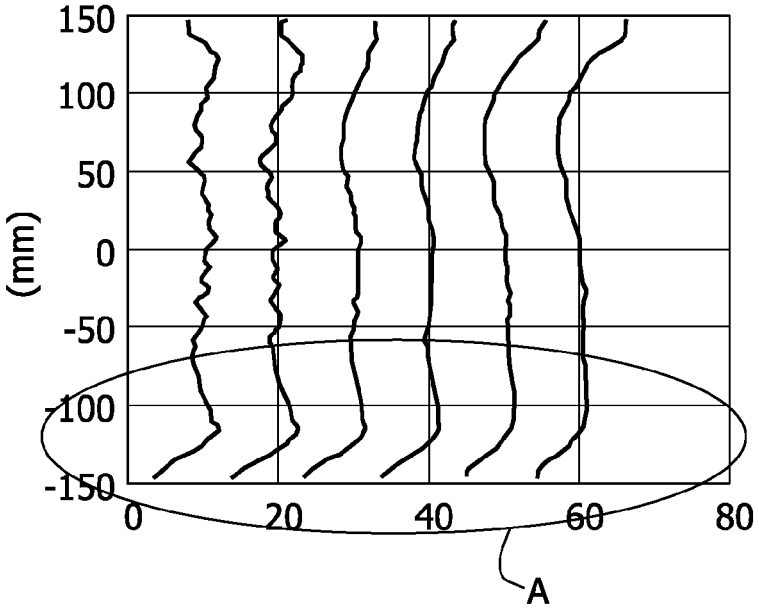
FIG. 4 is a graph showing the shape of a surface of a wafer sliced from an ingot attached to the wire saw machine in the centered position of FIG. 2.
Figure 5:
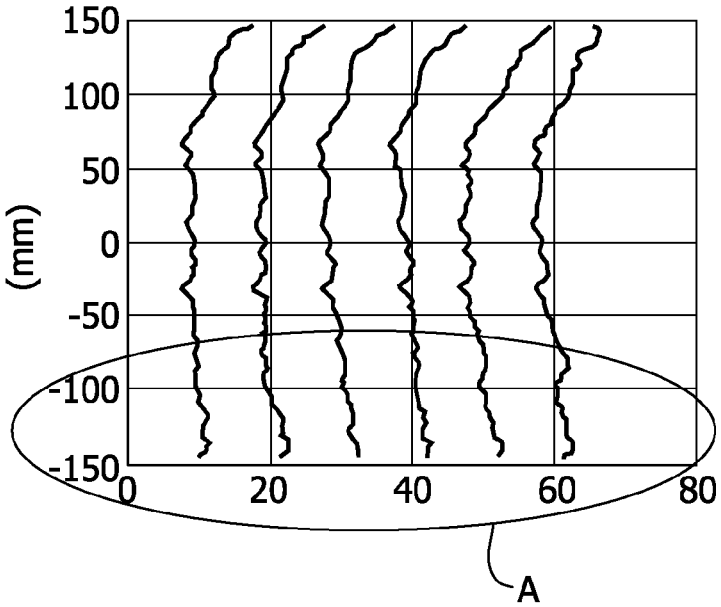
FIG. 5 is a graph showing the shape of a surface of wafer sliced from an ingot attached to the wire saw machine in the offset position of FIG. 3.

In prior systems, an irregularity (e.g., an entry mark or exit mark) is often formed in the surface of the wafer as it is sliced from the ingot 102 by the wire saw 103. The Graph of FIG. 4 shows the variations in the surfaces of six wafers sliced from an ingot 102 mounted at the center of the ingot holder 105 (e.g., the test ingot). The y-axis represents the relative location of the data measurement on the surface of the wafer, measured in millimeters, while the x-axis represents the surface displacement measurement of each wafer for the different data sets, in microns. On the y-axis, −150 mm corresponds to an initial point on the edge of the wafers where they were first contacted by the web of wires 104 of the saw 103. Also on the y-axis, 150 mm corresponds to a point on the edge of the wafers where they were last contacted by the web of wires 104. As shown in the indicated region A, each wafer surface has an irregularity that generally corresponds to an entry mark that is present in about the first 50 mm, closest to the edge of the wafer. The Graph of FIG. 5 is similar to that of FIG. 4, except that it shows the variations in surfaces of six wafers sliced according to the offset mounting methods described above. As shown in the indicated region A, the wafers lack any appreciable entry marks.

During operation, the components of the wire saw 103 increase in temperature. It is believed that this increase in temperature causes deflections in components of the wire saw 103, which in turn causes deflection of the web of wires 104. This deflection of the web of wires 104 is believed to be the cause of the irregularities formed in the surface of the wafer.

Offsetting the mounting location of the ingot 102 on the ingot holder 105 counteracts (i.e., compensates for) the causes of the irregularities in the surface of the wafers. The ingot 102 is mounted in a position offset from the center of the ingot holder 105 in a direction that is opposite that of the measured irregularity of the test wafer. The ingot 102 is spaced from the center of the ingot holder 105 by an offset distance that is based on the magnitude of the irregularity. Accordingly, the offset mounting of the ingot 102 counteracts the bias of the system which caused the formation of the irregularity in the test wafer.

In prior systems that produced wafers having surface irregularities, the wafers were subject to downstream processing operations (e.g., grinding, polishing, etc.) in order to remove the irregularities. The offset mounting location of the ingot described herein reduces the irregularities formed in the surfaces of wafers sliced by the wire saw. Thus, wafers sliced according to the method described above need not be subjected to the downstream processing operations necessary to remove surface irregularities.

Moreover, global wafer shape parameters (e.g., bow or warp) may also be altered by offsetting the mounting location of the ingot 102 on the ingot holder 105.

Accordingly, the amount of time and cost required to process the wafers after slicing is reduced. Moreover, global wafer shape parameters (e.g., bow or warp) may also be altered by offsetting the mounting location of the ingot on the ingot holder.

When introducing elements of the present disclosure or the embodiments thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the present disclosure, it is intended that all matter contained in the above description and shown in the accompanying drawings shall be interpreted as illustrative and not in a limiting sense.

What is claimed is:

1. A method of determining a mounting location of an ingot on an ingot holder, the ingot holder is used to attach the ingot to a wire saw machine for slicing the ingot into wafers, the ingot having a length, the method comprising:

measuring a test surface of a test wafer sliced by the wire saw machine from a test ingot, the test ingot having a test length;

determining a magnitude and a direction of an entry mark along the measured test surface;

determining a length ratio of the test length of the test ingot to the length of the ingot; and determining the mounting location of the ingot on the ingot holder based on the length ratio, and the magnitude and the direction of the entry mark of the measured test surface of the test wafer from the test ingot.

2. The method of claim 1 wherein the entry mark is an irregularity in the measured test surface of the test wafer.

3. The method of claim 1 wherein determining the mounting location of the ingot includes determining an offset distance from a center of the ingot holder, the offset distance is determined using at least one of the length ratio and the magnitude of the entry mark of the measured test surface of the test wafer.

4. The method of claim 3 wherein the offset distance is first determined using the magnitude of the entry mark of the measured test surface of the test wafer and is then one of reduced and increased based on the length ratio.

5. The method of claim 4 wherein the offset distance is reduced based on the length ratio when the length of the ingot is less than the test length of the test ingot.

6. The method of claim 4 wherein the offset distance is increased based on the length ratio when the length of the ingot is greater than the test length of the test ingot.

7. The method of claim 3 wherein determining the mounting location of the ingot includes determining an offset direction from the center of the ingot holder, the offset direction is based on the direction of the entry mark of the test measured surface of the test wafer.

8. The method of claim 7 wherein the offset direction is opposite that of the direction of the entry mark.

9. The method of claim 3 further comprising mounting the ingot to the ingot holder at the determined mounting location, the determined mounting location being spaced from the center of the ingot holder by the offset distance.

10. The method of claim 1 further comprising mounting the ingot to the ingot holder at the determined mounting location.

11. The method of claim 10 further comprising slicing the ingot into wafers, wherein at least one surface of the wafers has irregularities of reduced magnitude compared to a plurality of irregularities on the test surface of the test wafer sliced from the test ingot.

12. A method of determining a mounting location of an ingot on an ingot holder, the ingot holder is used to attach the ingot to a wire saw machine for slicing the ingot into wafers, the method comprising:

measuring a test surface of a test wafer previously sliced by the wire saw machine from a test ingot;

determining at least one of a magnitude and a direction of an irregularity of the measured test surface; and determining the mounting location of the ingot on the ingot holder using at least one of the magnitude and the direction of the irregularity of the measured test surface of the test wafer sliced from the test ingot, wherein determining the mounting location of the ingot includes determining an offset distance from a center of the ingot holder and an offset direction from the center of the ingot holder.

13. The method of claim 12 wherein the irregularity in the test surface of the test wafer is an entry mark.

14. The method of claim 12 wherein the offset distance is based on the magnitude of the irregularity of the measured test surface of the test wafer.

15. The method of claim 12 wherein the offset direction is based on the direction of the irregularity on the measured test surface of the test wafer.

16. The method of claim 12 wherein the offset direction is opposite that of the direction of the irregularity.

17. The method of claim 12 further comprising mounting the ingot to the ingot holder at the determined mounting location, the determined mounting location is spaced from the center of the ingot holder by the offset distance in the offset direction.

18. The method of claim 12 further comprising:

mounting the ingot to the ingot holder at the determined mounting location; and slicing the ingot with the wire saw machine into wafers, wherein at least one surface of the wafers has irregularities of reduced magnitude compared to a plurality of irregularities on the test surface of the test wafer sliced from the test ingot.

* * * * *